US005652937A

United States Patent [19]

Earle et al.

[11] Patent Number: 5,652,937

[45] Date of Patent: Jul. 29, 1997

[54] APPARATUS AND METHOD FOR SUPPLYING PROCESSING CHEMICALS

[75] Inventors: Anthony Earle, Middlesex; Edward Charles Glover, London, both of England

[73] Assignee: Eastman Kodak Company, Rochester, N.Y.

[21] Appl. No.: 559,586

[22] Filed: Nov. 16, 1995

[30] Foreign Application Priority Data

Nov. 24, 1994 [GB] United Kingdom ..... 94023739

[51] Int. Cl.[6] ..... G03D 3/02; G03D 13/00

[52] U.S. Cl. ..... 396/570; 396/626; 396/641

[58] Field of Search ..... 354/324, 331, 354/336; 222/83, 85, 564, 464, 318; 346/570, 626, 641, 622, 624

[56] References Cited

U.S. PATENT DOCUMENTS

| | | | |
|---|---|---|---|
| 3,095,796 | 7/1963 | Du Bois et al. | 354/336 |
| 3,260,186 | 7/1966 | Lowell . | |
| 3,687,050 | 8/1972 | Wilke | 95/89 R |
| 3,698,454 | 10/1972 | Cunha et al. | 141/375 |
| 4,518,240 | 5/1985 | Taylor et al. | 354/324 |
| 4,814,809 | 3/1989 | De Prijcker et al. | 354/324 |
| 4,968,998 | 11/1990 | Allen | 346/140 R |
| 5,148,208 | 9/1992 | Klosterboer et al. | 354/324 |
| 5,179,405 | 1/1993 | Osada et al. | 354/324 |
| 5,432,583 | 7/1995 | Ishikawa et al. | 354/324 |
| 5,488,447 | 1/1996 | Patton et al. | 354/324 X |

FOREIGN PATENT DOCUMENTS

| | | | |
|---|---|---|---|
| 0 500 371 A2 | 2/1992 | European Pat. Off. | G03D 3/06 |
| 2003262 | 1/1970 | Germany | G03D 3/02 |
| 980859 | 4/1960 | United Kingdom . | |
| 1212414 | 10/1967 | United Kingdom | B65D 31/16 |
| 2059383 | 7/1980 | United Kingdom | B65D 47/06 |
| 2068782 | 1/1981 | United Kingdom | G03D 13/00 |
| 2159123 | 10/1984 | United Kingdom | B65D 33/36 |
| 2194507 | 8/1987 | United Kingdom | B65D 33/36 |
| 93/04404 | 3/1993 | WIPO | G03D 3/00 |

*Primary Examiner*—D. Rutledge
*Attorney, Agent, or Firm*—Charles E. Snee, III

[57] ABSTRACT

A cartridge (1) for a processing chemical (3), such as a photographic developer or the like, comprises a main body (2) having an outlet (4, 5, 6, 7) by way of which the chemical may be introduced into and removed from the main body. The outlet is adapted for connection to a processing apparatus (8, 9, 10) to permit the chemical to be transferred between the apparatus and the cartridge. The main body of the cartridge incorporates a tube (6), one end of which is located externally of the main body. The tube extends through the interior of the main body so that its other end is disposed adjacent a region of the main body which is opposite that part of the main body where the outlet is formed. The cartridge is designed to be mounted on a processing apparatus with its outlet directed downwardly so that the tube stands substantially vertically. The processing chemical may be pumped out of the cartridge and back into the cartridge via the tube. In addition any air present in the cartridge may be pumped out of the cartridge via the same tube.

9 Claims, 2 Drawing Sheets

APPARATUS AND METHOD FOR SUPPLYING PROCESSING CHEMICALS

FIELD OF THE INVENTION

The present invention relates to processing chemicals and more particularly, but not exclusively, to apparatus and methods for supplying processing chemicals used during photographic processing.

BACKGROUND OF THE INVENTION

There are many applications, including photographic processing, where processing chemicals are supplied in liquid form in containers. When such a chemical is emptied from its container into a processing apparatus air will normally pass into the container naturally to replace the liquid so that the container is eventually filled with air. If the chemical is subsequently to be returned to the container provision must be made to accommodate any air which remains trapped within the container or which is entrained within the chemical as it is pumped back into the container or provision must be made to remove the air.

This is particularly important in the case of photographic processing chemicals such as developer, fixer or the like where the presence of air in the container for a processing chemical will cause oxidization and degradation of the chemical. Various methods are therefore used in order to try and exclude air from the container for a photographic processing chemical. It is not unknown, for example, for a lighted spill to be used in order to burn off the oxygen in a bottle used as a container for a photographic processing chemical. This is, however, far from an ideal solution. Another way in which the problem has been addressed is to provide a manually operated valve or vent tap in that region of the container which is located uppermost when it is in use so that the interior of the container may be connected to atmosphere to allow any air present in the container to escape as the container is filled with chemical. The construction of a container incorporating a manually operable vent of this type is, however, rather complex and therefore expensive and the vent must be operated manually. A container of this type is therefore not particularly suitable for use in an automated processing apparatus.

A further approach to the problem of excluding air from a container for a photographic processing chemical has been to design the container as a flexible "bag" or package which, when charged with a processing chemical, may be squeezed by hand in order to expel any air present in the container before the container is sealed closed. Again however this arrangement is really only suitable for manual use and where the processing chemicals are returned to their containers on an infrequent basis.

In addition a flexible foil package, i.e. a package formed from a thin membrane, is known which has only a single connection by way of which the chemical is introduced into and removed from the package and the flexible package collapses when the chemical is extracted and the pressure within the container decreases. Such a design has the limitation of only being of particular use when it is oriented with its connection located uppermost because otherwise air can become trapped in the package over successive cycles of operation and that air trapped in the package can eventually prevent the return of all of the processing chemical to the container. This can result in exhausted processing chemicals being left in a processing apparatus, which is particularly undesirable insofar as a photographic processing apparatus is concerned because any contaminated or exhausted solution left in a processing tank of a photographic processing apparatus will contaminate a fresh supply of processing chemical introduced into that tank.

SUMMARY OF THE INVENTION

The present invention seeks to provide a cartridge for a processing chemical which addresses these problems as well as a processing apparatus with which the cartridge may be used and a method of transferring a processing chemical between the cartridge and the processing apparatus.

According to one aspect of this invention there is provided a cartridge for a processing chemical, the cartridge comprising a main body for receiving the chemical, the main body having an outlet by way of which the chemical may be introduced into and removed from the main body, the outlet being adapted for connection to a processing apparatus to permit the transfer of the processing chemical between the cartridge and part of the processing apparatus, the main body further comprising a tube, one end of which is disposed externally of the main body, the tube extending through the interior of the main body so that the other end of the tube is disposed adjacent a region of the main body which is remote from that part of the main body where the outlet is formed.

Preferably the other end of the tube is disposed adjacent a region of the main body which is opposite that part of the main body where the outlet is formed. Conveniently the outlet is constituted by the one end of the tube which is disposed externally of the main body. Advantageously the one end of the tube which is disposed externally of the main body is provided with a penetrable self-sealing cover by way of which the cartridge may be connected to part of a processing apparatus. Preferably the tube is formed integrally with a component mounted on the main body of the cartridge at that point where the tube enters the main body. The tube may, alternatively, be formed from a plurality of parts. The main body of the cartridge may be formed of a flexible material. The cartridge may be charged with a photographic processing chemical.

A second aspect of this invention provides a processing apparatus comprising at least one tank for receiving a processing chemical and a system for supplying the chemical to the tank from a cartridge as described above and for returning the chemical to the cartridge, the supply and return system including means operable to transfer the chemical between the cartridge and the tank via the tube in the main body of the cartridge and means for removing air from the interior of the main body via the same tube. Preferably the supply and return system includes sensor means for controlling operation of the means for transferring the chemical and means for removing air from the interior of the main body. Conveniently the supply and return system includes a hollow needle connected to the tank for receiving the processing chemical, the needle being insertable into the cartridge via a penetrable, self-sealing cover provided on the outlet of the main body of the cartridge. The processing apparatus may be a photographic processing apparatus.

A third aspect of this invention provides a method of transferring a processing chemical from the cartridge of the invention to a processing apparatus of the invention and subsequently back to the cartridge, the method comprising the steps of connecting the cartridge to the processing apparatus, pumping air out of the main body of the cartridge via the tube in the main body of the cartridge, pumping the chemical from the cartridge to a tank in the processing apparatus via the tube in the main body of the cartridge, and subsequently pumping the chemical back into the cartridge via the same tube. Preferably the step of pumping air out of the main body of the cartridge is undertaken immediately prior to the step of pumping the chemical from the cartridge to a tank in the processing apparatus.

BRIEF DESCRIPTION OF THE DRAWINGS

In order that the present invention may be more readily understood and so that further features thereof may be appreciated the invention will now be described by way of example with reference to the accompanying drawings in which.

DETAILED DESCRIPTION OF THE INVENTION

Figure 1:
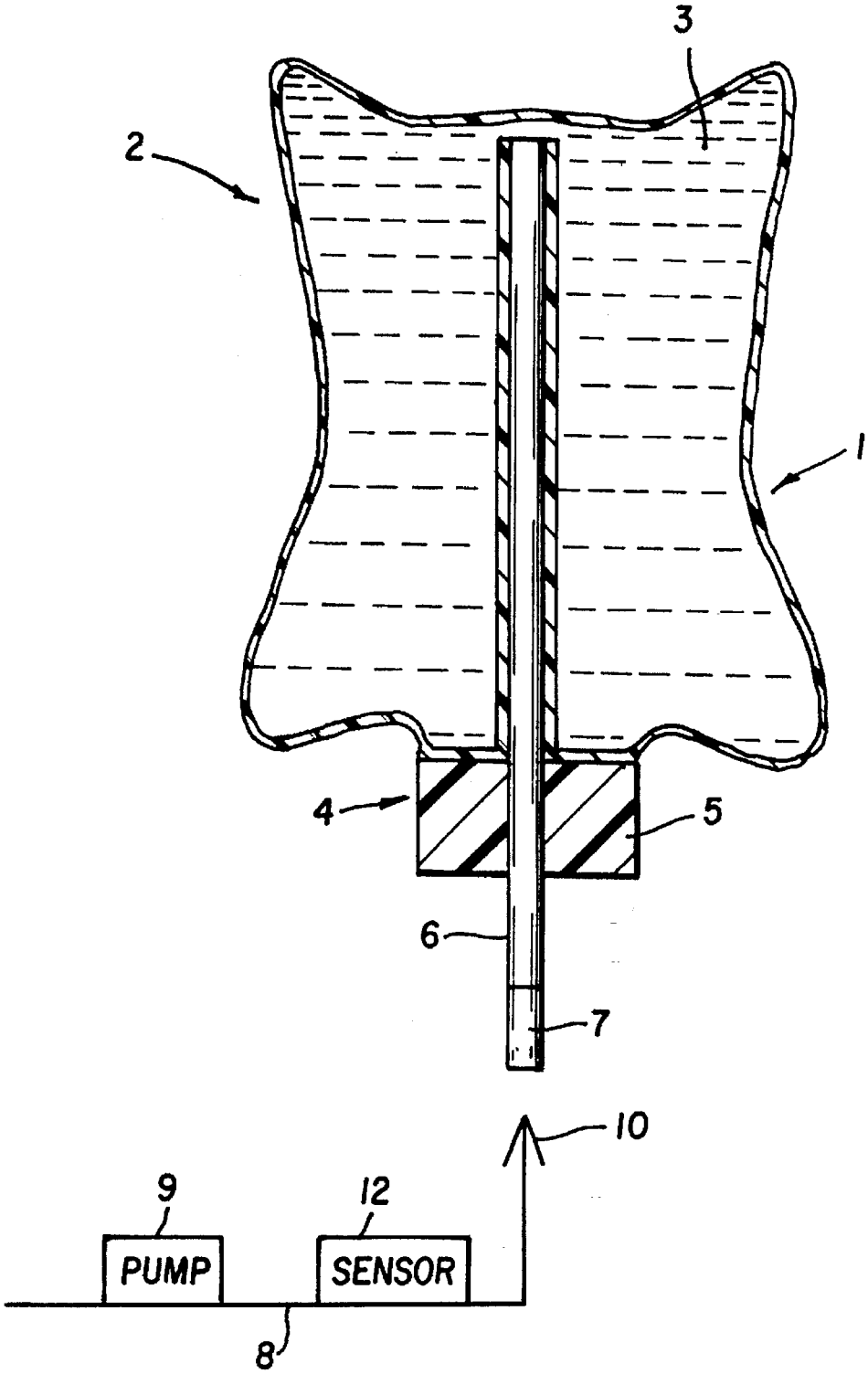
FIG. 1 is as schematic cross-sectional view of a cartridge containing a processing chemical which is sealed and ready for use.

The accompanying drawings show a cartridge 1 having a main body 2 in the form of a flexible bag or package containing a processing chemical 3 such as a photographic developer, fixer or the like. The main body 2 is formed with a connection 4 at one end by way of which material may be introduced into and removed from the cartridge. The connection 4 comprises a closure 5 formed over an opening in the flexible main body 2 of the cartridge, the closure 5 having an integrally formed pipe 6 passing centrally there through. The pipe 6 extends from outside the cartridge, where one end is closed by a penetrable, self-sealing cover or septum 7, through the closure 5 and through the interior of the main body 2 of the cartridge to terminate at a position adjacent the opposite end of the interior of the main body where the end of the pipe 6 is open. The penetrable, self-sealing cover 7 may take the form of a septum, such is as known for sealing biological sample bottles, formed of natural or synthetic rubber or any other elastic material with similar properties and which is penetrable yet self-sealing. The main body 2 of the cartridge may be formed from a thick membrane such as a plastics foil material and the pipe 6 can be formed from any suitable material such as a substantially rigid plastics material. The closure 5 is, of course, sealed to the material from which the main body 2 of the cartridge is formed so that the cartridge is completely air-tight.

While it is preferable that the main body of the cartridge be flexible, this is not essential and the main body could therefore be substantially rigid. Also it is to be noted that the pipe 6 need not be formed integrally with the closure 5 although this makes for a particularly compact arrangement. Indeed the pipe 6 could be a multi-part pipe. Thus the pipe may have one part located within the interior of the main body 2 and a second part which is connected thereto via the connection 4 and which is located outside of the main body. It should also be appreciated that the cartridge may be provided with any appropriate valve system instead of the septum 7 if desired.

In use the cartridge is filled with a processing chemical 3 and sealed by way of the cover or septum 7. When the chemical 3 is required for use in a processing apparatus the cartridge is connected to the apparatus by way of the projecting end of the pipe 6 which forms part of the closure 5. The processing apparatus has a chemical supply system by way of which the chemical 3 passes between the cartridge 1 and the processing apparatus, the chemical supply system comprising a pipeline 8 incorporating a pump 9. One end of the pipeline 8 is connected to a tank within the processing apparatus which is to receive the chemical 3 whilst the opposite end of the pipeline is provided with a hollow needle which is represented schematically by the arrow 10 in FIGS. 1 and 3 of the drawings. The cartridge is pushed onto the hollow needle 10 so that the needle penetrates the septum 7 and enters the pipe 6. The septum 7 closes up and forms a seal around the exterior of the needle 10. The arrangement is designed so that when the cartridge 1 is connected to the processing apparatus it is oriented with its connection 4 pointing downwardly. The pump 9 is then used to extract the processing chemical 3 from the main body 2 of the cartridge 1 and transfer it to a tank in the processing apparatus. The orientation of the cartridge 1 when in use ensures that any air present in the interior of its main body is withdrawn via the pipe 6 when the pump 9 is switched on so that the air is removed prior to the dispensing of the chemical 3.

Figure 2:
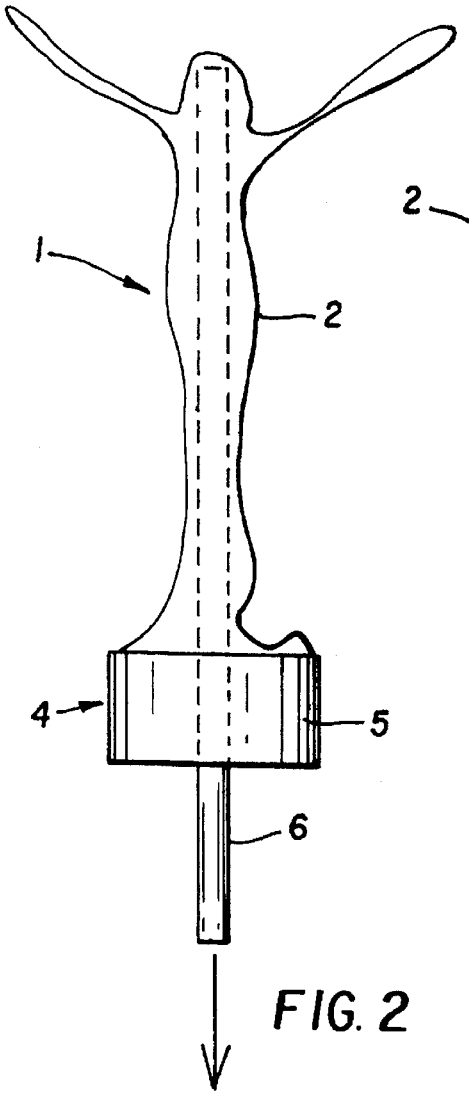
FIG. 2 shows the cartridge of FIG. 1 when the processing chemical has been extracted.

It will be appreciated that because the main body 2 is sealed it collapses as the processing chemical 3 is withdrawn by the pump 9 until it reaches the condition shown in FIG. 2, where all of the chemical 3 has been removed and the pump is then switched off.

Figure 3:
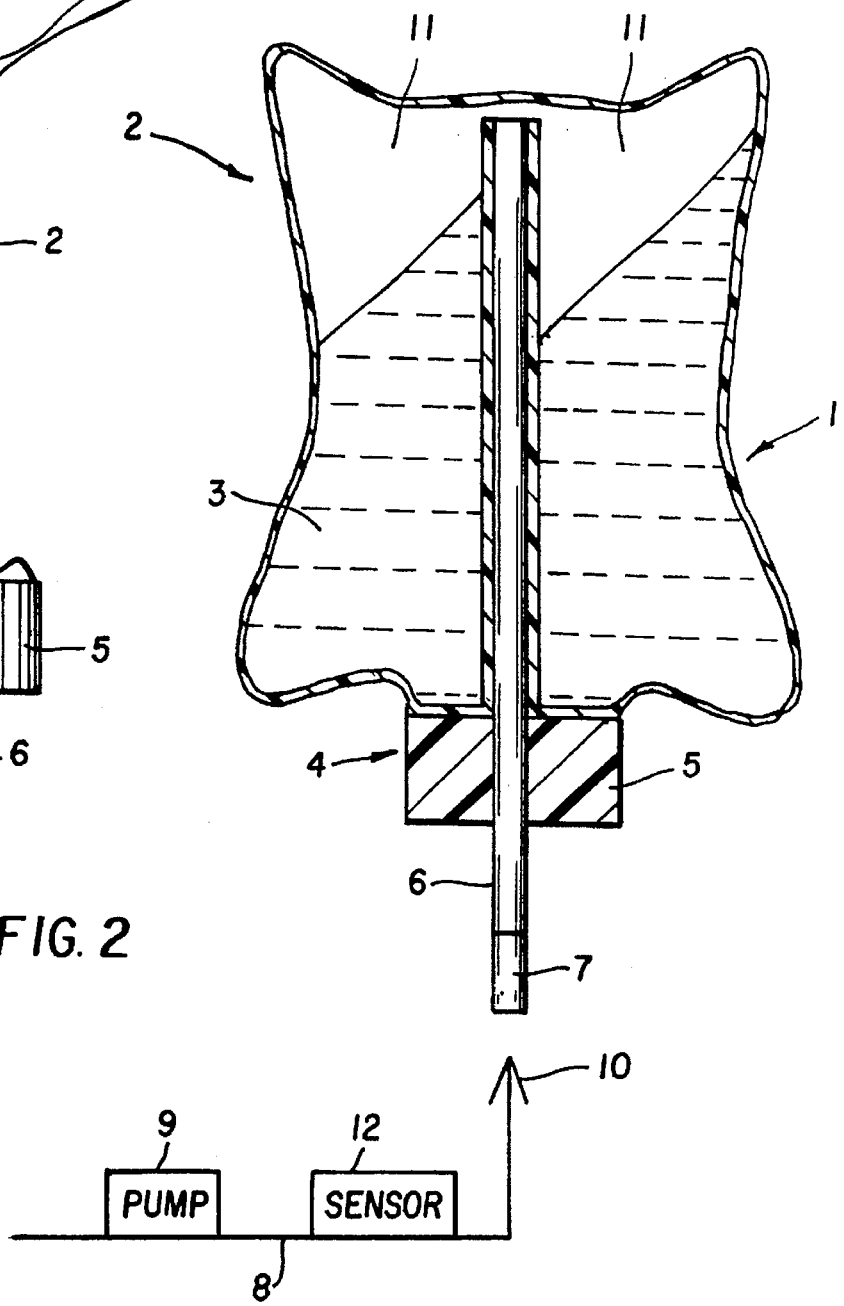
FIG. 3 is a view of the cartridge of FIGS. 1 and 2 as the processing chemical is being returned to the cartridge from a processing apparatus.

When the chemical 3 is to be returned to the cartridge 1 the pump 9 is switched on so as to extract the chemical from the tank in the processing apparatus and convey it back into the cartridge. The pump will, however, pull a mixture of air and liquid and so a certain volume of air will be pumped into the main body 2 of the cartridge with the processing chemical 3. In FIG. 3 a pocket of air in the main body 2 of the cartridge is identified by reference numeral 11. This build up of air in the cartridge imposes an increased load on the pump 9 as it tries to pump the remainder of the processing chemical 3 back into the cartridge. More importantly it could prevent the return of all of the chemical 3 to the cartridge and cause oxidization of the chemical therein, such as a photographic developer or fixer.

In order to address these problems, it is proposed that the cartridge and the chemical transfer system described above will be used such that when the build up of air in the main body 2 of the cartridge reaches a predetermined level the pump 9 is switched to "apparatus fill" mode in order to extract the air from the upper end of the main body of the cartridge. It will be recalled that the cartridge is connected to the processing apparatus with its connection 4 pointing downwards so that the pocket of air 11 will be trapped at the opposite, upper end of the main body 2 adjacent the open end of the pipe 6.

Thus, when the pump 9 is operated in the "apparatus fill mode" the air will be removed from the main body of the cartridge and pumped into the tank of the processing apparatus from where it can escape to atmosphere. When the air has been removed the pump may either be switched back into the mode whereby it withdraws the remaining chemical 3 from the processing apparatus and returns it to the cartridge or be shut down if all of the processing chemical, or nearly all of the chemical has already been returned to the cartridge.

If desired a sensor 12 may be provided in order to detect when all of the air 11 has been expelled from the main body of the cartridge. The sensor 12 may take any appropriate form and may, for example, comprise a pressure sensor monitoring the pressure in the pipeline between the pump 9 and the cartridge 1 and which causes the pump to extract a pocket of air 11 from the cartridge when the pressure builds up to a predetermined level. Alternatively the sensor may comprise a level sensor adapted to monitor the presence or absence of material at a predetermined level in the pipeline or even in the tank in the processing apparatus itself. Thus for example where a level sensor is used the sensor may automatically cause the pump 9 to be switched to a reverse mode of operation once all of the chemical 3 has been returned from the processing apparatus to the cartridge 1 so that the pump will then extract any air present in the cartridge until such time as all the air has been removed. Once all of the chemical 3 is back in the cartridge 1 and any air previously in the cartridge has been removed, the pump is switched off and the cartridge is removed from the processing apparatus by simply pulling it away from the needle 10. The septum 7 automatically seals the end of the pipe 6 so that the chemical 3 may be safely transported for disposal or recycling or stored until required for further use.

It is to be appreciated that although the invention is intended primarily for use with a cartridge containing a processing chemical in a liquid form the invention could be used with a cartridge containing pellets, powder or granules.

It will be appreciated that the design described above and illustrated in the accompanying drawings is particularly suited for use with a fully automated processing apparatus such as a photographic processing apparatus. Only a single connection is required on the cartridge 1 with that single connection being used for both the extraction and return of processing chemical and for the extraction of any unwanted air from the main body of the cartridge. The preferred design of cartridge can be connected to a processing apparatus in a very simple "push-on" manner. The chemical supply system by way of which the chemical is conveyed between the cartridge and the processing apparatus and the arrangement for extracting unwanted air from the cartridge can be operated using relatively simple logic. The task of removing unwanted air from the cartridge is therefore made relatively easy and the total original volume of the processing chemical can be maintained with the processing apparatus being fully emptied at all times thereby reducing the risk of any contaminated or exhausted chemical coming into contact with a supply of fresh processing chemical. The removal of unwanted air from the cartridge minimizes any oxidization which takes place during storage of the chemical. The preferred design of the cartridge 1 is relatively simple using known materials for forming the main body of the cartridge and a closure formed with an integral pipe as the only other main component. This simple design is therefore relatively inexpensive.

PARTS LIST 1. cartridge
2. main body of 1
3. processing chemical
4. connection at end of 2
5. closure
6. pipe
7. penetrable, self-sealing cover or septum
8. pipeline in associated processing apparatus
9. pump incorporated in 8
10. hollow needle to penetrate 7
11. pocket of air inside 2 when refill
12. sensor It will be appreciated that various modifications may be made to the specific design designed above and illustrated in the accompanying drawings without departing from the scope of the present invention as defined by the appendant claims.

What is claimed is:

1. Processing apparatus comprising at least one tank for receiving a processing chemical and a system for supplying the chemical to the tank from a cartridge and for returning the chemical to the cartridge, the supply and return system including means operable to transfer the chemical between the cartridge and the tank via a tube in the cartridge and means for removing air from the cartridge via the same tube, the cartridge comprising a main body for receiving the chemical, the main body being formed of a flexible material and having an outlet by way of which the chemical may be introduced into and removed from the main body, the outlet being adapted for connection to a processing apparatus to permit the transfer of the processing chemical between the cartridge and part of the processing apparatus, the main body further comprising a tube, one end of which is disposed externally of the main body, the tube extending through the interior of the main body so that the other end of the tube is disposed adjacent a region of the main body which is remote from that part of the main body where the outlet is formed.

2. Apparatus according to claim 1, wherein the outlet is constituted by said one end of the tube which is disposed externally of the main body, said one end being provided with a penetrable self-sealing cover by way of which the cartridge may be connected to part of a processing apparatus.

3. Apparatus according to claim 1, wherein the tube is formed integrally with a component mounted on the main body of the cartridge at that point where the tube enters the main body.

4. Apparatus according to claim 1, wherein the tube is formed from a plurality of parts.

5. Apparatus according to claim 1, wherein the supply and return system includes sensor means for controlling operation of the means for transferring the chemical and means for removing air from the interior of the main body.

6. Apparatus according to claim 1, wherein the supply and return system includes a hollow needle connected to said tank for receiving the processing chemical, the needle being insertable into the cartridge via a penetrable, self-sealing cover provided on the outlet of the main body of the cartridge.

7. Apparatus according to claim 1, wherein the apparatus is a photographic processing apparatus, and the cartridge is charged with a photographic processing chemical.

8. A method of transferring a processing chemical to photographic processing apparatus from a cartridge and subsequently back to the cartridge, the cartridge comprising a main body for receiving the chemical, the main body being formed of a flexible material and having an outlet by way of which the chemical may be introduced into and removed from the main body, the outlet being adapted for connection to the processing apparatus to permit the transfer of the processing chemical between the cartridge and part of the processing apparatus, the main body further comprising a tube, one end of which is disposed externally of the main body, the tube extending through the interior of the main body so that the other end of the tube is disposed adjacent a region of the main body which is remote from that part of the main body where the outlet is formed, the method comprising steps of:

connecting the cartridge to the processing apparatus, pumping air out of the main body of the cartridge via the tube in the main body of the cartridge, pumping the chemical from the cartridge to a tank in the processing apparatus via the tube in the main body of the cartridge, whereby the main body collapses as the chemical is withdrawn, and subsequently pumping the chemical back into the cartridge via the same tube.

9. A method according to claim 8, wherein the step of pumping air out of the main body of the cartridge is undertaken immediately prior to the step of pumping the chemical from the cartridge to a tank in the processing apparatus.

* * * * *